US007497984B2

(12) United States Patent
Aström

(10) Patent No.: US 7,497,984 B2
(45) Date of Patent: Mar. 3, 2009

(54) DEVICE FOR COOLING LONG OBJECTS

(75) Inventor: Anders Aström, Munich (DE)

(73) Assignee: Linde Aktiengesellschaft, Munich (DE)

( * ) Notice: Subject to any disclaimer, the term of this patent is extended or adjusted under 35 U.S.C. 154(b) by 13 days.

(21) Appl. No.: 11/801,455

(22) Filed: May 10, 2007

(65) Prior Publication Data

US 2007/0289678 A1 Dec. 20, 2007

(30) Foreign Application Priority Data

Nov. 11, 2004 (DE) ..... 10 2004 054 627
Oct. 25, 2005 (EP) ..... PCT/EP2005/011447

(51) Int. Cl.
*C21D 1/62* (2006.01)

(52) U.S. Cl. ..... 266/113; 266/111

(58) Field of Classification Search ..... 266/111, 266/113, 103
See application file for complete search history.

(56) References Cited

U.S. PATENT DOCUMENTS 3,675,908 A * 7/1972 Amend ..... 266/113
4,448,614 A 5/1984 Morimoto et al.
4,515,645 A 5/1985 Bohm
2002/0195753 A1 12/2002 Kay
2006/0048868 A1 3/2006 Lefevre et al.

OTHER PUBLICATIONS

Ferrari et al.; "An Evaluation of Multiple-Jet Impingement Gas Quenching of Steel Rings"; Thesis: Studies of Flow and Heat Transfer in Gas Quenching; Quench Chambers; Impringement Cooled Bodies; and Inverse Solutions (Licentiate Thesis Stockholm 2002) Jan. 19, 2002; pp. 1-21, TRITA-MEK-Technical Report 2002, 02, ISSN 0348-467X, ISRN KTH/MEK/PR-02/01-SE, Stockholm, Sweden.

* cited by examiner

*Primary Examiner*—Scott Kastler
(74) *Attorney, Agent, or Firm*—Joshua L. Cohen

(57) ABSTRACT

The invention relates to a device for cooling long objects such as wires, tubes or rods. In order to provide improved cooling, provision is made of a nozzle region which has a diameter greater than the diameter of the object and contains a plurality of nozzles which blow a cooling gas at the object, and a cladding tube whose diameter is equal to or less than the diameter of the nozzle region.

7 Claims, 1 Drawing Sheet

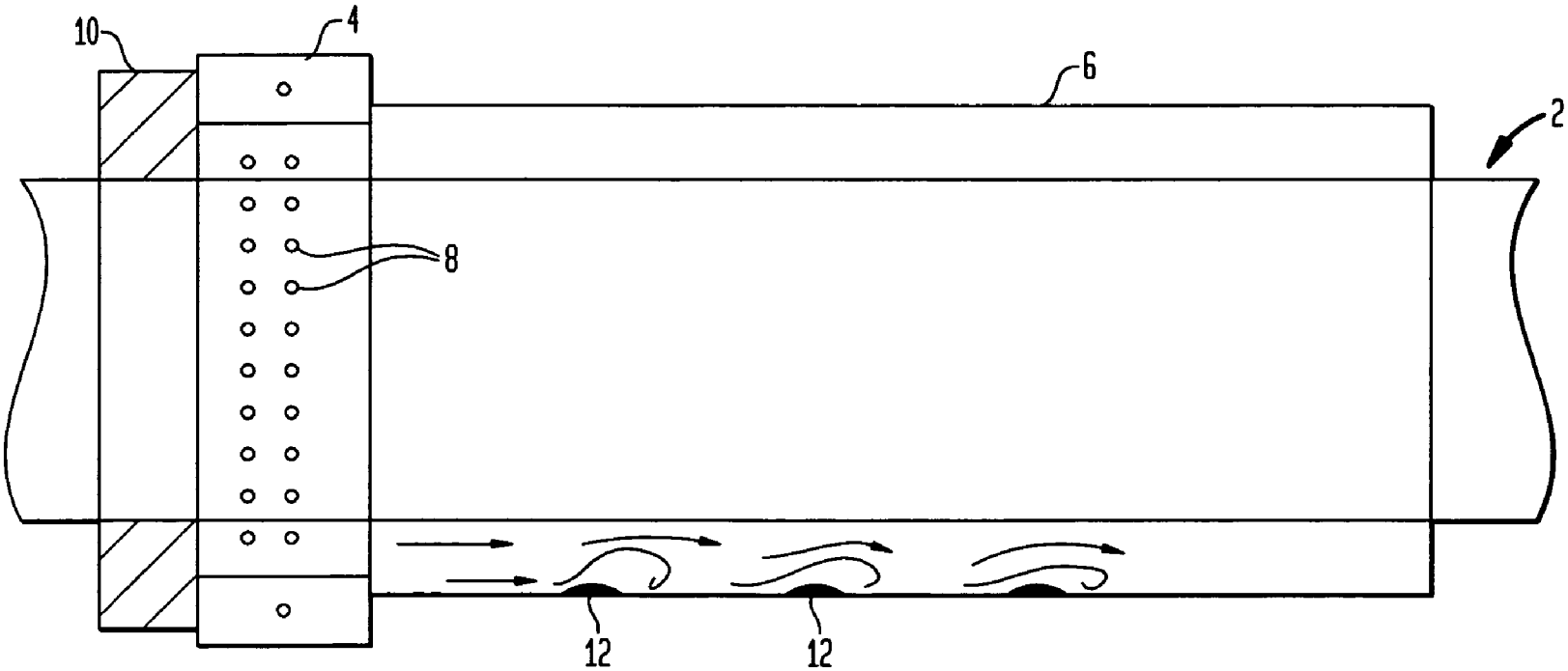
2
6
4
8
10
12
12

DEVICE FOR COOLING LONG OBJECTS

CROSS-REFERENCE TO RELATED APPLICATION

This application claims priority under 35 U.S.C. §119 to German Patent Application No. DE1020040546, filed in the German Patent and Trade Mark Office, the disclosure of which is incorporated by reference herein in its entirety.

FIELD OF THE INVENTION

1. Field of the Disclosure

The invention relates to a device for cooling long objects.

2. Description of the Related Art

Long objects include wires, tubes, rods, spring steels, plates and similar objects whose longitudinal extent is significantly larger than the extents of width and/or height. When producing (casting or drawing) "endless" objects of said type, or after heat treatment, rapid cooling (quenching) is often necessary in order to suitably transform the microstructure.

A device is known from the article "An Evaluation of Multiple-Jet Impingement Gas Quenching of Steel Rings" by J. Ferrari, N. Lior, of 19 Jan. 2002, in which device ball bearings are placed in a field of gas nozzles. In order to rapidly cool or quench the hot ball bearings, gas flows are conducted to the objects through a plurality of nozzles in order to rapidly cool said objects. That device is only suitable for relatively compact objects which does not have excessively large extentions.

SUMMARY OF THE INVENTION

At least one embodiment of the invention relates to a device with which long or endless objects can be gas-cooled in a reliable, rapid and economical fashion. This invention relates to a device for cooling long objects having a nozzle region which has a diameter greater than the diameter of the object and contains a plurality of nozzles which blow a cooling gas at the object, and having a cladding tube whose diameter is equal to or less than the diameter of the nozzle region.

BRIEF DESCRIPTION OF THE DRAWINGS

Exemplary embodiments of the present invention will become readily apparent by reference to the following detailed description when considered in conjunction with the accompanying drawings wherein the FIGURE is a side view of the device according to the present invention.

DETAILED DESCRIPTION OF THE EXEMPLARY EMBODIMENTS

Various embodiments of the device according to the invention has two differently-dimensioned chambers or regions, with a plurality of nozzles being provided in the first chamber (nozzle region), which nozzles blow cold gas jets at the object to be cooled. The second region (cladding tube) is relatively long and encloses the object to be cooled over a relatively long region. The gap formed between the object to be cooled and the inner wall of the cladding tube is traversed by cold gas, which has been sprayed from the nozzles toward the object and thereby either cools the object further if the object moves in the direction of the gas, or pre-cools the object if the movement direction of the object runs counter to the gas direction. With a relatively narrow design of the gap between the cooling chamber and the object to be cooled, it is possible to obtain relatively intimate contact between the gas and the object, so that the cooling action of the gas is utilized relatively effectively. The cross section of the cladding tube is matched to the object to be cooled. If the object is round, the cladding tube is also cylindrical; in the case of rectangular bars, the cladding tube is rectangular. The cladding tube encloses the object closely, so that the cooling gas is conducted close to the object.

In one embodiment of the invention, a sealing region can be situated at one side of the nozzle region, which sealing region bears relatively closely against the object to be cooled and prevents cooling gas escaping in this direction. This has the advantage that the cooling gas flows only in the preferred direction.

In another embodiment, the cladding tube has a smaller diameter than the nozzle region. As a result, the contact between the gas and the object to be cooled is even more intimate. At the same pressure, the gas speed is higher through the relatively small gap, and the cooling action is intensified.

All known technical gases can be used as gases for purposes of this invention. For example, nitrogen, hydrogen, helium or nitrogen-hydrogen mixtures, nitrogen-helium mixtures, hydrogen-helium mixtures or ternary mixtures of nitrogen, hydrogen and helium are advantageous.

The gases can preferably be re-used. In particular in the case of helium, hydrogen or other expensive gases, it is expedient to re-use and cool the gases in a heat exchanger for one further cycle or for several cycles. In the case of less expensive gases such as nitrogen or carbon dioxide, this can be dispensed with.

The dimensions of the objects to be cooled can start from wires of approximately 1 mm diameter and extend up to tubes of any desired diameters, that is to say from a number of centimeters to a number of meters in diameter. Starting temperatures can be in the range of 400 to 1400° C., with the start temperature being dependent on the composition and the requirements during quenching. The gas pressures for spraying can be between 0 and 10 bar.

In at least one embodiment, the nozzles for discharging the gas jets are aligned in such a way that they blow in the radial direction at the object to be cooled, so that the entire periphery of the object is uniformly impinged.

The pressure within the spray nozzles is between 1 and 10 bar. In another embodiment, the pressure is between 1 and 3 bar, for example is 2 bar, with impingement or impact speeds of between 70 and 200 m/sec. In another embodiment, the impingement or impact speed is between 100 and 180 m/s, then being obtained. Speeds up to the speed of sound are also possible. For certain nozzle types, the impingement speeds can even be greater than the speed of sound.

In one embodiment, the spacing between the object to be cooled and the gas-conducting cladding is selected such that the speed in the cladding tube gap is between 1 and 10 m/s. In an embodiment, the cladding tube gas is between 3 and 6 m/s.

The direction of the gas can run either in the same direction as the product or in the opposite direction to the product. If a system of that type is connected to a furnace or to a device for casting, drawing or producing the metal, the object will always move in one direction. The gas can then flow parallel to the same direction or in the opposite direction. The gas flow may be in the opposite direction, because more uniform cooling is then obtained. If such an opposing flow cannot be provided, the flow can also take place in the direction of the product.

If the length of the cooling device is not sufficient to cool the object to a sufficient degree, a plurality of units of that type can be connected in series in order to provide sufficient cooling capacity.

On the other hand, the gap between the cooling jacket and the object should not be so small that a considerable counterpressure is generated and the gas is impeded from flowing out, so that a significant counterpressure with respect to the gas flowing out of the nozzles is generated. On the other hand, the gas volume should be controlled in such a way that the gas which leaves the unit is not impermissibly hot.

Turbulence-generating units (swirling elements) can be installed within the tube, which turbulence-generating units disrupt the laminar flow, generate turbulence and thereby lead to improved cooling.

The length of the cladding tube is selected such that, together with the product speed, the intended end temperature of the product is reached. This is possible by means of longer lengths if a lower end temperature is desired.

One embodiment of the invention is explained in more detail on the basis of a FIGURE. The FIGURE schematically shows the object 2 to be cooled, in this case a rod or tube, within the cooling device according to the invention. The cooling device according to the invention contains a nozzle region 4 and a cladding tube 6 which adjoins the nozzle region 4. The nozzles 8 are indicated schematically in the nozzle region 4. The nozzle region 4 is adjoined to the left by a sealing region 10 which bears relatively closely against the object 2 and prevents a discharge of the gas to the left. Shown at the bottom are swirling elements 12, which can also extend over the entire periphery of the cladding tube.

The function is as follows:

The object 2 to be cooled moves either from left to right or from right to left through the device according to the invention. For cooling, cold gas is blown through the nozzles 8 at the object 2. As a result, the object 2 is cooled intensely in the nozzle region 4. The gas then flows through the gap between the object 2 and the cladding tube 6 to the right, cooling the object 2 further.

Various embodiments of the device according to the present invention have dimensions such as where the length of the cladding tube is 2 to 50, such as 30 to 50 times its diameter. The length of the cladding tube may be between 0.1 and 1 m. The gaps between the object 2 and the cladding tube 6 may be between 5 and 20 mm. The nozzle diameters are for example 1.2 mm. The length of the nozzle region is between a number of centimeters and decimeters.

For a good heat transfer coefficient, the jet diameter (d) may be 0.1 to 0.2 m×the spacing to object (H). In an embodiment, d is 0.18H. The spacing of the nozzle centers from one another (t) may be 1 to 1.5H. In an embodiment, t is 1.3H.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A device for cooling long objects, comprising a nozzle region which has a diameter greater than a diameter of an object to be cooled and through which the object can pass, the nozzle region including a plurality of nozzles which blow a cooling gas at the object; and a cladding tube adjoined to the nozzle region and having a diameter not greater than the diameter of the nozzle region and through which the object can pass; the nozzle region and cladding tube adjoined and disposed for providing a gap for the cooling gas to flow from the nozzle region to between the object and the cladding tube for cooling the object.

2. The device according to claim 1, further comprising a sealing member adjoined to the nozzle region for preventing discharge of the cooling gas.

3. The device according to claim 1, wherein a length of the cladding tube is 2 to 50 times its diameter.

4. The device according to claim 1, wherein the cladding tube has a length of 0.1 to 1 m.

5. The device according to claim 1, further comprising a heat exchanger for re-cooling the cooling gas such that the cooling gas can be re-used on the object.

6. The device according to claim 1, wherein the plurality of nozzles of the nozzle region are aligned to spray the cooling gas toward the object at a pressure of between 1 and 10 bar.

7. The device according to claim 1, further comprising at least one turbulence generating member disposed in the gap to disrupt a flow of the cooling gas along the object.

* * * * *